US007621103B1

(12) United States Patent
Sorkin

(10) Patent No.: US 7,621,103 B1
(45) Date of Patent: Nov. 24, 2009

(54) DUCT SYSTEM FOR PROFILED POST-TENSION CONSTRUCTION

(76) Inventor: Felix L. Sorkin, 13022 Trinity Dr., Stafford, TX (US) 77477

( * ) Notice: Subject to any disclaimer, the term of this patent is extended or adjusted under 35 U.S.C. 154(b) by 720 days.

(21) Appl. No.: 10/984,023

(22) Filed: Nov. 8, 2004

(51) Int. Cl.
*E04C 5/08* (2006.01)

(52) U.S. Cl. ..... 52/843; 52/223.3; 52/223.1; 405/259.1

(58) Field of Classification Search ..... 52/223.3, 52/223.1, 223.14; 405/259, 259.1
See application file for complete search history.

(56) References Cited

U.S. PATENT DOCUMENTS 5,474,335 A 12/1995 Sorkin
5,701,707 A 12/1997 Sorkin
5,720,139 A 2/1998 Sorkin
5,762,300 A 6/1998 Sorkin
5,775,849 A * 7/1998 Sorkin ..... 405/259.1
D400,670 S 11/1998 Sorkin
5,954,373 A 9/1999 Sorkin
6,584,959 B2 * 7/2003 Stieler ..... 123/468
6,659,135 B2 12/2003 Sorkin
6,666,233 B1 12/2003 Sorkin
6,752,435 B1 6/2004 Sorkin
D492,987 S 7/2004 Sorkin
D492,988 S 7/2004 Sorkin
6,764,105 B1 7/2004 Sorkin
6,806,427 B2 * 10/2004 Kadotani et al. ..... 174/70 C
7,055,553 B2 * 6/2006 Bessette et al. ..... 138/141
7,273,238 B1 * 9/2007 Sorkin ..... 285/354

* cited by examiner

*Primary Examiner*—Basil Katcheves
(74) *Attorney, Agent, or Firm*—Egbert Law Offices PLLC

(57) ABSTRACT

A duct system for profiled post-tendon construction has a first duct, a second duct and a third duct joined together in end-to-end relationship. The first and third ducts are of one type of polymeric material. The second duct is of a different type of polymeric material. The second duct has a parabolic curvature while the first and third ducts are generally straight. The second duct has a cross-sectional configuration that is identical to the cross-sectional configuration of the first and third ducts.

14 Claims, 2 Drawing Sheets

DUCT SYSTEM FOR PROFILED POST-TENSION CONSTRUCTION

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to ducts as used in post-tension construction. More particularly, the present invention relates to ducts that are used for receiving tendons in a multi-strand tensioning system in an encapsulated environment. Additionally, the present invention relates to ducts as used for load balancing and for profiled post-tension construction.

BACKGROUND OF THE INVENTION

For many years, the design of concrete structures imitated the typical steel design of column, girder and beam. With technological advances in structural concrete, however, its own form began to evolve. Concrete has the advantages of lower cost than steel, of not requiring fireproofing, and of its plasticity, a quality that lends itself to free flowing or boldly massive architectural concepts. On the other hand, structural concrete, though quite capable of carrying almost any compressive load, is weak in carrying significant tensile loads. It becomes necessary, therefore, to add steel bars, called reinforcements, to concrete, thus allowing the concrete to carry the compressive forces and the steel to carry the tensile forces.

Structures of reinforced concrete may be constructed with load-bearing walls, but this method does not use the full potentialities of the concrete. The skeleton frame, in which the floors and roofs rest directly on exterior and interior reinforced-concrete columns, has proven to be most economic and popular. Reinforced-concrete framing is seemingly a quite simple form of construction. First, wood or steel forms are constructed in the sizes, positions, and shapes called for by engineering and design requirements. The steel reinforcing is then placed and held in position by wires at its intersections. Devices known as chairs and spacers are used to keep the reinforcing bars apart and raised off the form work. The size and number of the steel bars depends completely upon the imposed loads and the need to transfer these loads evenly throughout the building and down to the foundation. After the reinforcing is set in place, the concrete, a mixture of water, cement, sand, and stone or aggregate, of proportions calculated to produce the required strength, is placed, care being taken to prevent voids or honeycombs.

One of the simplest designs in concrete frames is the beam-and-slab. This system follows ordinary steel design that uses concrete beams that are cast integrally with the floor slabs. The beam-and-slab system is often used in apartment buildings and other structures where the beams are not visually objectionable and can be hidden. The reinforcement is simple and the forms for casting can be utilized over and over for the same shape. The system, therefore, produces an economically viable structure. With the development of flat-slab construction, exposed beams can be eliminated. In this system, reinforcing bars are projected at right angles and in two directions from every column supporting flat slabs spanning twelve or fifteen feet in both directions.

Reinforced concrete reaches its highest potentialities when it is used in pre-stressed or post-tensioned members. Spans as great as one hundred feet can be attained in members as deep as three feet for roof loads. The basic principle is simple. In pre-stressing, reinforcing rods of high tensile strength wires are stretched to a certain determined limit and then high-strength concrete is placed around them. When the concrete has set, it holds the steel in a tight grip, preventing slippage or sagging. Post-tensioning follows the same principle, but the reinforcing tendon, usually a steel cable, is held loosely in place while the concrete is placed around it. The reinforcing tendon is then stretched by hydraulic jacks and securely anchored into place. Pre-stressing is done with individual members in the shop and post-tensioning as part of the structure on the site.

In a typical tendon tensioning anchor assembly used in such post-tensioning operations, there are provided anchors for anchoring the ends of the cables suspended therebetween. In the course of tensioning the cable in a concrete structure, a hydraulic jack or the like is releasably attached to one of the exposed ends of each cable for applying a predetermined amount of tension to the tendon, which extends through the anchor. When the desired amount of tension is applied to the cable, wedges, threaded nuts, or the like, are used to capture the cable at the anchor plate and, as the jack is removed from the tendon, to prevent its relaxation and hold it in its stressed condition.

Multi-strand tensioning is used when forming especially long post-tensioned concrete structures, or those which must carry especially heavy loads, such as elongated concrete beams for buildings, bridges, highway overpasses, etc. Multiple axially aligned strands of cable are used in order to achieve the required compressive forces for offsetting the anticipated loads. Special multi-strand anchors are utilized, with ports for the desired number of tensioning cables. Individual cables are then strung between the anchors, tensioned and locked as described above for the conventional monofilament post-tensioning system.

As with monofilament installations, it is highly desirable to protect the tensioned steel cables from corrosive elements, such as de-icing chemicals, sea water, brackish water, and even rain water which could enter through cracks or pores in the concrete and eventually cause corrosion and loss of tension of the cables. In multi-strand applications, the cables typically are protected against exposure to corrosive elements by surrounding them with a metal duct or, more recently, with a flexible duct made of an impermeable material, such as plastic. The protective duct extends between the anchors and in surrounding relationship to the bundle of tensioning cables. Flexible duct, which typically is provided in 20 to 40 foot sections is sealed at each end to an anchor and between adjacent sections of duct to provide a water-tight channel. Grout then may be pumped into the interior of the duct in surrounding relationship to the cables to provide further protection.

The powerful and widely used method for designing post-tensioned concrete slabs is the load-balancing technique. In the load-balancing or "equivalent load" method, the tendon is mentally removed and replaced with all of the loads it exerts on the member. The concrete member is then analyzed as a free-body, with the equivalent set of tendon loads acting in combination with other external loads (normally the dead and live load). The equivalent loads are easy to visualize and, once they are determined for any tendon force and profile, that can be treated like any other externally applied load. The loads imposed by the tendon can be replaced by equivalent loads composed of horizontal and vertical forces, moments at the external supports, and transverse forces along the tendon profile. Transverse forces are generated by the curvature of the change in profile of the tendon. They can be in the form of a concentrated force due to an abrupt change in the slope of a tendon profile, a uniform load, or a distributed variable load.

Various patents have issued, in the past, for devices relating to such multi-strand duct assemblies. For example, U.S. Design Pat. No. 400,670, issued on Nov. 3, 1998, to the present inventor, shows a design of a duct. This duct design includes a tubular body with a plurality of corrugations extending outwardly therefrom. This tubular duct is presently manufactured and sold by General Technologies, Inc. of Stafford, Tex., the licensee of the present inventor.

The present inventor is also the inventor of U.S. Pat. No. 5,474,335, issued on Dec. 12, 1995. This patent describes a duct coupler for joining and sealing between adjacent sections of duct. The coupler includes a body and a flexible levered section on the end of the body. This flexible levered section is adapted to pass over annular protrusions on the duct. Locking rings are used to lock the flexible levered sections into position so as to lock the coupler onto the duct.

U.S. Pat. No. 5,762,300, issued on Jun. 9, 1998, to the present inventor, describes a tendon-receiving duct support apparatus. This duct support apparatus is used for supporting a tendon-receiving duct. This support apparatus includes a cradle for receiving an exterior surface of a duct therein and a clamp connected to the cradle and extending therebelow for attachment to an underlying object. The cradle is a generally U-shaped member having a length greater than a width of the underlying object received by the clamp. The cradle and the clamp are integrally formed together of a polymeric material. The underlying object to which the clamp is connected is a chair or a rebar.

U.S. Pat. No. 5,954,373, issued on Sep. 21, 1999 to the present inventor, shows another duct coupler apparatus for use with ducts on a multi-strand post-tensioning system. The coupler includes a tubular body with an interior passageway between a first open end and a second open end. A shoulder is formed within the tubular body between the open ends. A seal is connected to the shoulder so as to form a liquid-tight seal with a duct received within one of the open ends. A compression device is hingedly connected to the tubular body for urging the duct into compressive contact with the seal. The compression device has a portion extending exterior of the tubular body.

U.S. Pat. No. 6,666,233, issued on Dec. 23, 2003 to the present inventor, shows another form of a tendon-receiving duct. In this duct, each of the corrugations is in spaced relationship to an adjacent corrugation. The tubular body has an interior passageway suitable for receiving cables therein. Each of the corrugations opens to the interior passageway. The tubular body has a first longitudinal channel extending between adjacent pairs of the corrugations on the top side of the tubular body. The tubular body has a pair of longitudinal channels extending between adjacent pairs of the corrugations on a bottom side of the tubular body.

U.S. Design Pat. No. D492,987, issued on Jul. 13, 2004, to the present inventor, illustrates a design of a three-channel duct having a plurality of generally trapezoidal-shaped ribs with a first channel extending across a top of the tubular body and a pair of channels extending across the bottom of the tubular body.

U.S. Design Pat. No. D492,988, issued on Jul. 13, 2004 to the present inventor, discloses a monostrand duct for receiving a single tendon therein. This monostrand duct has a plurality of ribs formed along the exterior of the body. Each of the ribs has a generally box-like cross-section. A pair of diametrically-opposed longitudinal channels extend along the length of the duct and between each of the ribs.

With all of these polymeric duct constructions, the use of such ducts in association with profiled load-balancing tendons has been somewhat difficult. Generally, the ducts of the prior art have been formed of a polymeric material, such as polyethylene or polypropylene. However, when tendons are profiled by using the load-balancing technique, a curvature in the tendon will occur. As a result, certain of the tendons will bear against an inner wall of the duct in the area of the curvature. Under the enormous tension loads that applied to the tendon, the contact between the tendons and the inner wall of such ducts can potentially impair the integrity of the duct system. As a result, in the past, designers of load-balanced post-tension systems have utilized steel pipe joined to the longitudinally extending ducts in order to provide the requisite durability and wear-resistance of the duct system at the area of the tendon curvature.

FIG. 1 illustrates the prior art system. As can be seen, the prior art duct system 10 has a pipe 12 that is positioned between polymeric ducts 14 and 16 at opposite ends thereof. The pipe 12 is typically of steel construction that has been formed and bent so as to fit the curvature of the tendons or cables extending therethrough. Ducts 14 and 16 have a configuration similar to that described in the prior art patents to the present inventor. Couplers 18 and 20 are used to join ducts 14 and 16 to the respective ends of the pipe 12.

Unfortunately, the use of steel pipe 12 greatly impairs the integrity of the duct system. First, and foremost, polymeric ducts 14 and 16 are intended to be used so as to avoid any corrosion to the post-tension system. When the steel pipe 12 is introduced into the system, the potential for corrosion, deterioration and damage can occur. Ultimately, salts can leach through the concrete into the area of the steel pipe 12 and effectively corrode the steel pipe 12 and damage the integrity of the encapsulated system.

The steel pipe 12 is also electrically conductive. As a result, any electrical forces passing adjacent to the structure can be introduced into the tendons within the duct system by way of contact with the steel pipe 12. Ultimately, the application of electrical currents to the tendons can cause electrolytic effects on the tendons and the post-tension system. Cathodic or anodic reactions can occur which can damage the integrity of the tendons within the post-tension system. As such, it has been important, in the past, to avoid any electrical effects, to provide electrical isolation of the tendons, and to reduce electrolytic effects. The application of the steel pipe 12 directly conflicts with desired goals.

As can be seen in FIG. 1, the steel pipe 12 has a generally tubular construction. There are no corrugations or ribs provided along the length or opening to the interior of the pipe 12. As a result, the adherence between the cables, the grout, and the walls of the tubular steel pipe 12 will be minimal. Additionally, and furthermore, the tubular pipe 12 has smooth exterior walls. As a result, the steel pipe 12 lacks any corrugations that can strongly adhere to and resist movement relative to the structure. The steel pipe 12 has minimal "pull out" strength and resistance. As a result, the beneficial effects associated with the ducts 14 and 16 will not be found in the area of the steel pipe 12.

In normal use, it would be possible to avoid the corrosive effects on the steel pipe 12 by galvanizing the steel pipe 12 or by forming the pipe 12 of a stainless steel material. Either approach is extremely expensive and requires a great deal of additional effort in order to achieve the desired results. Once again, even if the steel pipe 12 is suitably galvanized, it will still not have the electrical isolation effects or the load-bearing effects.

It is an object of the present invention to provide a tendon-receiving duct system which improves the integrity of the system in the area of tendon curvature and in the area of load-balancing.

It is another object of the present invention to provide a tendon-receiving duct system which avoids the harmful effects of steel pipe in the area of tendon curvature.

It is still a further object of the present invention to provide a tendon-receiving duct system which improves the load-bearing capability of the duct, in combination with the tendon, in the area of the curvature of the tendon.

It is still a further object of the present invention to provide a tendon-receiving duct system which easy to manufacture, easy to install, easy to implement and relatively inexpensive.

These and other objects and advantages of the present invention will become apparent from a reading of the attached specification and appended claims.

BRIEF SUMMARY OF THE INVENTION

The present invention is a duct system for profiled post-tendon construction comprising a first duct of a first polymeric material, a second duct of a second polymeric material and a third duct of a third polymeric material. The second polymeric material is more wear-resistant than the first and third polymeric materials. The second duct has one end joined to the first duct and opposite end joined to the third duct.

The second duct will having a generally parabolic curvature. The first and third ducts are generally straight.

The second duct has longitudinal axis with a cross-section transverse to the longitudinal axis that is identical to a cross section of the first and second ducts transverse to the longitudinal axis thereof. A first coupler is affixed to one end of the second duct and to an end of the first duct. The first coupler serves to seal the first and second ducts in liquid-tight end-to-end relationship. A second coupler is affixed to an opposite end of the second duct and to an end of the third duct. The second coupler serves to seal the second and third ducts in liquid-tight end-to-end relationship.

In the present invention, the second duct has a plurality of ribs formed therealong. This plurality of ribs communicates with an interior passageway of the second duct. The plurality of ribs are in spaced parallel relationship to each other. The plurality of ribs extends outwardly of an outer wall of the second duct. A longitudinal channel extends linearly along the plurality of ribs between the ends of the second duct. The longitudinal channel is in liquid communication with the interior passageway of the second duct.

In the present invention, the first and third polymeric materials are of an identical material. The second polymeric material is of a nylon material. The first and third polymeric materials can either be polyethylene or polypropylene. In the preferred embodiment of the present invention, the second polymeric material is a glass-filled nylon material.

DETAILED DESCRIPTION OF THE INVENTION

Figure 1:
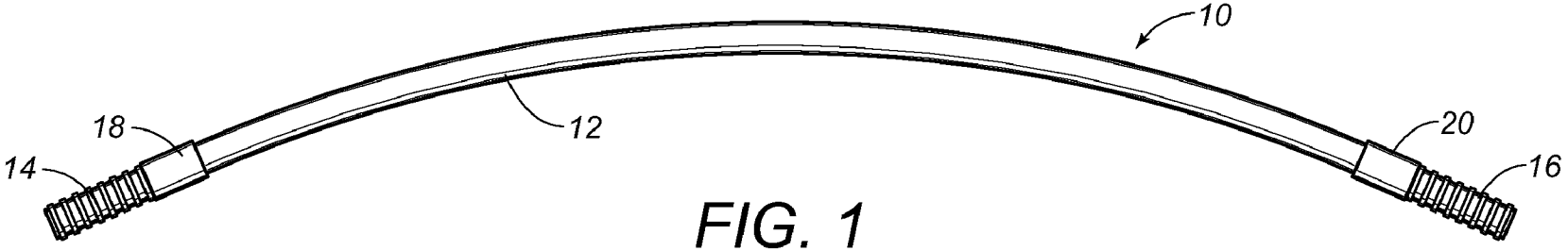
FIG. 1 Prior Art
FIG. 1 is a side elevational view of the prior art duct system for profiled post-tension construction.
Figure 2:
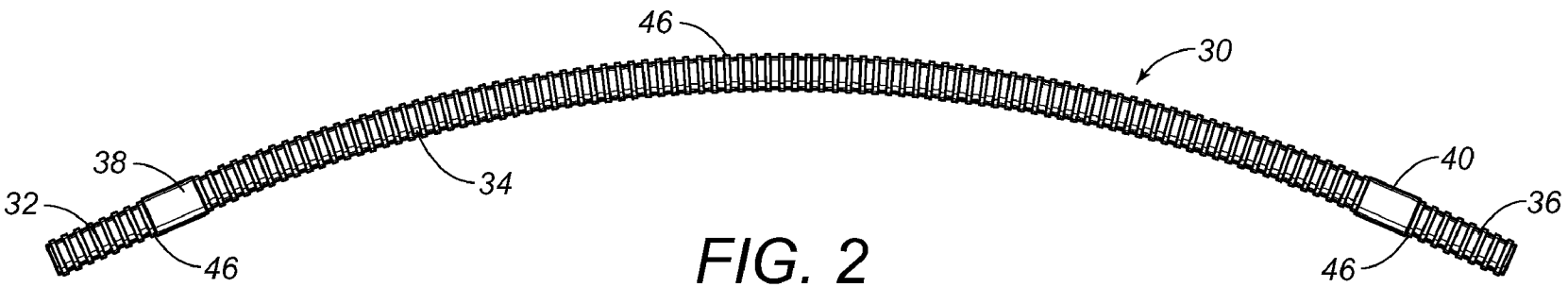
FIG. 2 is a side elevational view showing the duct system for profiled post-tension construction in accordance with the present invention.

Referring to FIG. 2, there is shown the duct system 30 in accordance with the preferred embodiment of the present invention. The duct system 30 includes a first duct 32, a second duct 34, and a third duct 36. The first duct 32 is of a first polymeric material. The second duct 34 is of a second polymeric material. The third duct 36 is of a third polymeric material. The polymeric material used for the second duct 34 is more wear resistant than the polymeric materials used for the first duct 32 or the third duct 36. As can be seen, a coupler 38 is used to join one end of the second duct 34 to an end of the first duct 32. A second coupler 40 is used to join the opposite end of the second duct 34 to an end of the third duct 36. Couplers 38 and 40 can have a variety of configuration including, but not limited to, the configuration of couplers described in U.S. Pat. Nos. 5,474,335, 5,775,849 and 5,954,373 to the present inventor.

It is important to note that, with respect to the couplers 38 and 40, couplers 38 and 40 can be formed in the configuration of these prior art patents. Each of these prior art patents requires that the coupler be joined to a duct having corrugations (or ribs) and be of a polymeric material. In contrast, the couplers 18 and 20 of the prior art must be of a special configuration so as to join the ends of polymeric ducts 14 and 16 to the respective ends of steel pipe 12. It has been extremely difficult to form such a coupling mechanism that avoids the separation of the ducts 14 and 16 from the pipe 12 during the application of the tension forces to the tendons therein. In other words, it is quite difficult for the couplers 18 and 20 to effectively adhere to the smooth surfaces of the steel pipe 12 in order to effectively resist being pulled therefrom. In normal practice, construction workers will normally utilize tape so as to join the ends of the ducts 14 and 16 to the respective ends of the steel pipe 12. The use of such tape ineffectively prevents liquid intrusion into the interior of the pipe 12 or the ducts 14 and 16. Such tape provides inadequate liquid resistance and will easily deteriorate over time and with exposure to the elements within the concrete structure.

In contrast, the use of the polymeric duct 34 facilitates the ability to use couplers 38 and 40 of the prior art. The duct 34 has suitable corrugations thereon (as will be described hereinafter) whereby strong compressive and sealing forces can be imparted by the respective couplers 38 and 40 so as to join the ends of the second duct 34 in liquid-tight end-to-end relationship with the ducts 32 and 36. The strong sealing forces imparted by the couplers 38 and 40 also serve to effectively resist separation of the ducts 32 and 36 from the duct 34 during the application of tensioning forces.

As can be seen in FIG. 2, the duct 34 has a generally parabolic curvature. Ducts 32 and 36 are generally straight. The duct 34 generally has a similar configuration as ducts 32 and 36 except for the curvature thereof. In other words, the second duct 34 has a cross section that is transverse to a longitudinal axis thereof that is identical to a cross section transverse to the longitudinal axis of either of the first duct 34 or the third duct 36.

The ducts 32 and 34 are, in the preferred embodiment of the present invention, formed of identical polymeric materials. In particular, the preferred polymeric materials for either of the ducts 32 and 36 is either polyethylene or polypropylene. However, since duct 34 must be made of a more wear-resistant or durable material than either of ducts 32 and 36, duct 34 should be formed of a nylon material. In the preferred embodiment of the present invention, the maximum amount of wear resistance can be obtained by the use of glass-filled nylon material.

It is important to note that the cost of the system is minimized since the second duct 34 can be formed with similar equipment as used for the formation of ducts 32 and 36. It is just the material that is used for the second duct 34 that is different than the ducts 32 and 36. As a result, expensive glass-filled nylon is only required for the curved section of the duct system 30 and not for the remaining ducts of the system. If necessary, the duct 34 can be formed of a different color than ducts 32 and 36 so as to assure easy inspection of the installed system and to properly inform the construction workers that the second duct 34 must be placed on the curved portion of the tendons extending therethrough.

Figure 3:
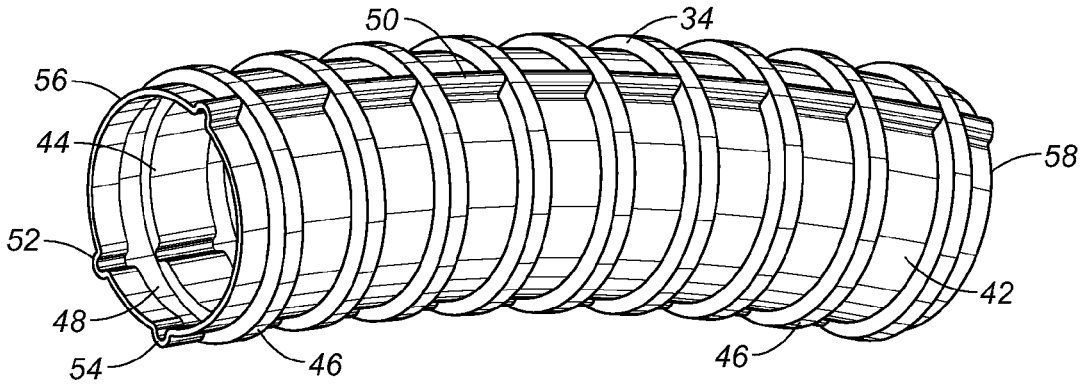
FIG. 3 is an isolated view of the curved duct as used in the duct system of the present invention.

FIG. 3 shows a portion of the second duct 34 as used in the system of the present invention. As can be seen, the duct 34 has a generally tubular shape with a wall 42 defining the interior passageway 44 of duct 34. A plurality of ribs (or corrugations) 46 are formed so as to extend outwardly of the wall 42 and to have an interior 48 that communicates with the interior passageway 44 of duct 34. A first longitudinal channel 50 will extend along the length of the duct 34 and open to the plurality of corrugations 46. A pair of longitudinal channels 52 and 54 are formed adjacent to the bottom of the duct 34. Longitudinal channels 52 and 54 also extend between the ends 56 and 58 of the duct 34 and also open into the interior passageway 44. Although FIG. 3 shows a shape of a duct such as described previously in U.S. Pat. No. 6,666,233, a variety of other duct configurations can be used within the concept of the present invention. However, it is relatively important that the corrugations (or ribs) 46 are formed on the duct 34. The application of such ribs 46 assures that the grout that cements the tendons to the interior 44 of the duct 34 can be properly cemented within the interior passageway 44. Once the grout has solidified, the grout filling the various ribs 46 will prevent any "pull out" effects between the tendons and the wall 42 of duct 34. Additionally, each of the ribs 46 provides an outwardly extending surface whereby the respective couplers 38 and 40 can be in compressive liquid-tight sealing relationship therewith. The ribs 46 provide a surface whereby the concrete structure through which the duct 34 extends will have a load bearing surface thereon which prevents the duct 34 from being pulled through or longitudinally displaced from the structure in which it is received. Longitudinal channels 50, 52 and 54 assure that the grout therein can be evenly distributed throughout the various ribs 46 and between the ends 56 and 58 of the duct 34. The longitudinal channels 50, 52 and 54 also assure that air bubbles formed within each of the ribs 46 can be pushed outwardly toward either of the ends 56 and 58 of the duct 34.

As can be seen in FIG. 3, the duct 34 has a generally parabolic curvature. The duct 34, in the preferred embodiment of the present invention, is formed of a glass-filed nylon material. The polymeric duct 34 will have an ability to conform to the curvature of the tendons extending therethrough. As such, it may not be necessary to form or shape the duct 34 at the work site. The duct 34 has a minimal cost relative to the prior use of pipe 12. Additionally, installation of the duct 34 can be carried out in a similar manner as the installation of the remaining duct sections 32 and 36. The duct 34 is relatively lightweight. The duct 34 can be easily positioned and manipulated as desired so as to meet the requirements for the load balancing of the structure in which the duct 34 is retained.

Figure 4:
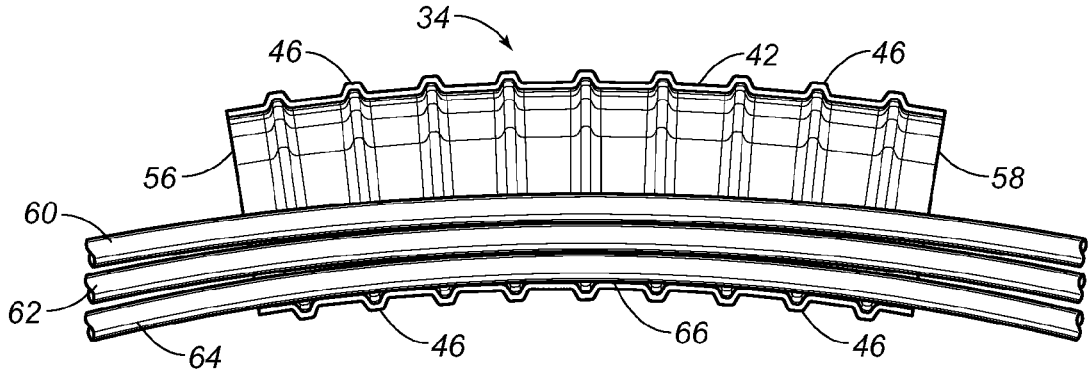
FIG. 4 is a cross-sectional view showing how the tendons extend through the interior of the duct system of the present invention.

FIG. 4 shows the interior of the duct 34 relative to the tendons 60, 62 and 64. The importance of the greater durability of duct 34 is illustrated when it can be seen that the tendon 64 generally bears against the inner wall 66 of the duct 34. Since the duct 34 is formed of very wear resistant and durable material, any load-bearing contact between the tendon 64 and the inner wall 66 of duct 34 will not damage or impair the integrity of the duct 34. The various corrugations 46 are illustrated as extending outwardly of the wall 42 of the duct 34. The ends 56 and 58 of the duct 34 can be suitably joined to the standard duct sections 32 and 36 in the manner illustrated in FIG. 2.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A duct system for profiled post-tendon construction comprising:

a first duct being of a first polymeric material;

a second duct being of a second polymeric material, said second duct having a plurality of ribs formed thereon and extending outwardly therefrom, each of said plurality of ribs communicating with an interior passageway of said second duct, each of said plurality of ribs having an outwardly extending surface;

a third duct being of a third polymeric material, said second polymeric material being more wear resistant than said first and third polymeric materials, said second duct having a curvature greater than a curvature of said first and third ducts;

a first coupler affixed to one end of said second duct and to an end of said first duct so as to seal said first and second ducts in liquid-tight end-to-end relationship, said first coupler being in compressive liquid-tight relationship with at least one rib of said plurality of ribs adjacent said one end of said second duct; and a second coupler affixed to an opposite end of said second duct and to an end of said third duct so as to seal said second and third ducts in liquid-tight end-to-end relationship, said second coupler being in compressive liquid-tight relationship with at least one rib of said plurality of ribs adjacent said opposite end of said second duct, said first and second couplers having a length substantially less than a length of said second duct.

2. The system of claim 1, said first and third ducts being generally straight.

3. The system of claim 1, said second duct having a longitudinal axis, said second duct having a cross-section transverse to said longitudinal axis that is identical to a cross section of said first and third ducts that is transverse to a longitudinal axis of said first and third ducts.

4. The system of claim 1, each of said plurality of ribs being in spaced parallel relation to an adjacent rib.

5. The system of claim 1, said second duct having an longitudinal channel extending linearly across all of said plurality of ribs between said ends of said second duct, said longitudinal channel being in liquid communication with said interior passageway of said second duct.

6. The system of claim 1, said first and third polymeric materials being of an identical material.

7. The system of claim 6, said second polymeric material being a nylon material, said first and third polymeric material selected from the group consisting of polyethylene and polypropylene.

8. The system of claim 7, said second polymeric material being a glass-filled nylon material.

9. A post-tension duct system comprising:

a first duct formed of a first polymeric material;

a second duct formed of a second polymeric material, said second duct having a longitudinal axis extending between a first end and a second end thereof, said second duct having a plurality of ribs formed thereon, said plurality of ribs communicating with an interior passageway of said second duct, each of said plurality of ribs being in spaced parallel relationship to an adjacent rib, said plurality of ribs extending outwardly of an outer wall of said second duct;

a third duct formed of a third polymeric material, said second polymeric material having a durability that is greater than a durability of said first and third polymeric materials, said second duct having a curvature greater than a curvature of said first duct and said third duct;

a plurality of tendons extending through said first duct and said second duct and said third duct, said plurality of tendons having a curvature therealong, at least one of said plurality of tendons bearing against a portion of only one side of an interior wall of said second duct, said curvature of said second duct generally conforming to said curvature of said plurality of tendons;

a first coupler affixed to one end of said second duct and to an end of said first duct as to seal said first and second ducts in liquid-tight end-to-end relationship, said first coupler being in compressive liquid-tight relationship with at least one rib of said plurality of ribs adjacent said one end of said second duct; and a second coupler affixed to an opposite end of said second duct and to an end of said third duct so as seal said second and third ducts in liquid-tight relationship, said second coupler being in compressive liquid-tight relationship with at least one rib of said plurality of ribs adjacent said opposite end of said second duct, said first and second couplers having a length substantially less than a length of said second duct.

10. The system of claim 9, said second duct having a longitudinal axis, said second duct having a cross-section transverse to said longitudinal axis that is identical to a cross section of said first and third ducts that extends transverse to a longitudinal axis of said first and third ducts.

11. The system of claim 9, said second duct having an longitudinal channel extending linearly across all of said plurality of ribs between said ends of said second duct, said longitudinal channel being in liquid communication with said interior passageway of said second duct.

12. The system of claim 9, said first and third polymeric materials being of an identical material.

13. The system of claim 12, said second polymeric material being a nylon material, said first and third polymeric materials selected from the group consisting of polyethylene and polypropylene.

14. The system of claim 9, said second duct having a parabolic curvature, said first and third duct being generally straight.

* * * * *